US007775740B2

(12) United States Patent
Berritta

(10) Patent No.: US 7,775,740 B2
(45) Date of Patent: Aug. 17, 2010

(54) CONCRETE TROWEL STEERING SYSTEM

(75) Inventor: Roberto Berritta, Fiesso D'Artico (IT)

(73) Assignee: Wacker Neuson Corporation, Menomonee Falls, WI (US)

( * ) Notice: Subject to any disclaimer, the term of this patent is extended or adjusted under 35 U.S.C. 154(b) by 499 days.

(21) Appl. No.: 11/782,844

(22) Filed: Jul. 25, 2007

(65) Prior Publication Data

US 2009/0028642 A1 Jan. 29, 2009

(51) Int. Cl.
*E01C 19/22* (2006.01)

(52) U.S. Cl. ..... 404/112

(58) Field of Classification Search ..... 404/112
See application file for complete search history.

(56) References Cited

U.S. PATENT DOCUMENTS 4,046,484 A 9/1977 Holz, Sr. et al.
5,108,220 A 4/1992 Allen et al.
5,480,258 A * 1/1996 Allen ..... 404/112
5,899,631 A * 5/1999 Jaszkowiak ..... 404/112
6,368,016 B1 4/2002 Smith et al.
7,172,365 B2 2/2007 Lutz et al.

FOREIGN PATENT DOCUMENTS

EP 1 069 259 A2 1/2001

OTHER PUBLICATIONS

European Search Report for Application No. 08013465.3, Dated Jun. 24, 2009.

* cited by examiner

*Primary Examiner*—Raymond W Addie
(74) *Attorney, Agent, or Firm*—Boyle Fredrickson, S.C.

(57) ABSTRACT

A self-propelled concrete finishing trowel has a steering system that counteracts a portion of the load associated with operator manipulation of a steering handle. A steering linkage connects the steering handle to a rotor assembly. A steering assist mechanism, preferably including a torsion bar or a spring, imposes a preload on the steering linkage to reduce handle actuation forces. The steering assist mechanism reduces handle retention forces, required to maintain the handle in a particular position after moving the handle to that position, to less than about 20 lbs throughout the stroke of the operating handle.

20 Claims, 12 Drawing Sheets

CONCRETE TROWEL STEERING SYSTEM

BACKGROUND OF THE INVENTION

1. Field of the Invention

The invention relates generally to concrete finishing trowels and, more particularly, to a steering system for finishing trowels that support an operator during use, i.e. riding trowels.

2. Description of the Related Art

A variety of machines are available for smoothing or otherwise finishing wet concrete. These machines range from simple hand trowels, to walk-behind trowels, to self-propelled riding trowels. Regardless of the mode of operation of such trowels, the powered trowels generally include one to three rotors that rotate relative to the concrete surface. Riding finishing trowels can finish large sections of concrete more rapidly and efficiently than manually pushed or guided hand-held or walk behind finishing trowels. The present invention is directed to riding finishing trowels.

More particularly, the invention relates to a concrete finishing trowel, such as a riding trowel, having rotor assemblies that can be tilted for a steering operation. Riding concrete finishing trowels of this type typically include a frame having a cage that generally encloses two, and sometimes three or more, rotor assemblies. Each rotor assembly includes a driven shaft and a plurality of trowel blades mounted on and extending radially outwardly from the bottom end of the driven shaft. The driven shafts of the rotor assemblies are driven by one or more engines mounted on the frame and typically linked to the driven shafts by gearboxes of the respective rotor assemblies.

The weight of the finishing trowel, including the operator, is transmitted frictionally to the concrete surface by the rotating blades, thereby smoothing the concrete surface. The pitch of individual blades can altered relative to the driven shafts via operation of a lever and/or linkage system during use of the machine. Such a construction allows the operator to adjust blade pitch during operation of the power trowel. As commonly understood, blade pitch adjustment alters the pressure applied to the surface being finished by the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

The rotor assemblies of riding trowels also can be tilted relative to the vertical for steering purposes. By tilting the rotor assemblies, the operator can utilize the frictional forces imposed on the blades by the concrete surface to propel the vehicle. Generally, the vehicle will travel in a direction perpendicular to the direction of tilt of the driven shaft. Specifically, tilting the rotor assembly from side-to-side and fore-and-aft steers the vehicle in the forward/reverse and the left/right directions, respectively. It is also commonly understood that, in the case of a riding trowel having two rotor assemblies, the driven shafts of both rotor assemblies should be tiltable side-to-side for forward/reverse steering control, whereas only the driven shaft of one of the rotor assemblies needs to be tilted fore and aft for left/right steering control.

Many steering assemblies are mechanically operated. These assemblies typically include two steering control handles mounted adjacent the operator's seat and accessible by the operator's left and right hands, respectively. Each lever is coupled, via a mechanical linkage assembly, to a pivotable gearbox of an associated rotor assembly. The operator steers the vehicle by tilting the levers fore-and-aft and side-to-side to tilt the gearboxes side-to-side and fore-and-aft, respectively. Steering assemblies of this type are disclosed, e.g., in U.S. Pat. No. 4,046,484 to Holz and U.S. Pat. No. 5,108,220 to Allen et al.

Mechanically operated steering control assemblies of the type disclosed in the Holz and Allen et al. patents are somewhat difficult to operate because they require the imposition of a significant physical force by the operator both to move the handles to a particular position and to retain them in that position. The typical steering control handle requires 20-40 pounds of force to operate in either its fore-and-aft direction or its side-to-side direction. Most operators experience fatigue when exerting these forces, particularly when one considers that the operator must exert these forces continuously or nearly continuously for several hours at a time with little or no rest. Operator fatigue is particularly problematic with respect to side-to-side motions, which, due to the ergonomics of the machines, are considerably more difficult for operators to impose than fore-and-aft motions.

Proposals have been made to replace the traditional mechanically operated steering control assemblies of a concrete finishing machine with power-actuated assemblies. For instance, Whiteman Industries, Inc., of Carson, Calif. has introduced a hydraulically steered riding trowel under its tradename "HTS-Series." This machine is hydrostatically driven via hydrostatic pumps which are powered by the machine's engine and which supply pressurized hydraulic fluid both to hydraulic motors of the rotor assemblies, and to hydraulic steering cylinders which tilt the driven shafts of the rotor assemblies. The steering assemblies are controlled by joysticks mounted on the operator's platform adjacent the operator's seat. These joysticks are easier to operate than traditional mechanical levers. The operator therefore does not experience the fatigue experienced by operators of traditional, mechanically steered machines.

A hydrostatically steered concrete finishing trowel, though superior in some respects to a mechanically steered machine, exhibits its own drawbacks and disadvantages. For instance, the hydrostatic pump, hydraulic motor, steering cylinders, and associated hydraulic devices render the machine very heavy. Accordingly, even with the blades set at their minimum pitch so as to distribute the machine's weight over a maximum area, the operator must let the concrete set longer than otherwise would be necessary before he or she can perform the initial, so-called "floating" finishing operation. This delay hinders a finishing operation because it leaves the operator with less time to finish the concrete. In addition, the complex hydraulic system required by hydrostatically steered machines is prone to leaks. Oil spills on fresh concrete are, of course, undesirable. Finally, hydrostatically steered machines are considerably more expensive than manually-steered machines due to the relatively large and expensive hydraulic motors, valves, etc.

Accordingly, there is a need for a ride-on concrete finishing trowel steering system that does not unnecessarily increase the weight of the machine and yet requires less steering effort than previously-known manually steered machines. It is further desired to provide a ride-on trowel steering system that can be implemented into a number of machine configurations as well as one that is relatively simple to operate, inexpensive to produce, and simple to maintain.

SUMMARY OF THE INVENTION

The present invention provides a power concrete finishing trowel that overcomes one or more of the above-mentioned drawbacks. A steering system according to one aspect of the invention includes a steering system that is relatively simple, lightweight, and inexpensive.

Another aspect of the invention is to provide a power concrete finishing trowel that meets the first principal aspect and that substantially eliminates or at least significantly reduces operator fatigue.

Yet another aspect of the invention is to provide a power concrete finishing trowel that meets the first aspect and that does not require pressurized or otherwise contained fluids for its operation and, hence, exhibits reduced possibility of fluid spills when compared to systems requiring pressurized fluids for their operation.

One or more of these aspects are achieved by a steering system for a power trowel that includes a steering assist mechanism that imposes a preload on the steering linkage to reduce handle actuation forces required to move the handle to a particular position. The steering assist mechanism also reduces handle retention forces, required to maintain the handle in a particular position after moving the handle to that position, to less than about 20 lbs throughout the operating stroke of the handle. In fact, systems have been successfully demonstrated that reduce the maximum retention forces to less than 15 lbs and even to about 10 lbs. In one embodiment, a biasing link is engaged with the steering linkage and extends from a torsion bar between generally opposite ends of the torsion bar. A load link is connected to the torsion bar and imparts a preload upon the torsion bar such that the torsion bar carries a portion of the load associated with tilting the rotor assembly.

Another aspect of the invention relates to a concrete finishing trowel having first and second rotor assemblies attached to a frame. Each rotor assembly includes a shaft constructed to support a number of blades. An engine drives the shaft of the rotor assemblies such that each of the blades rotates across a concrete surface. A steering linkage is operatively connected to the rotor assemblies to tilt the rotor assembly relative to the frame. First and second handles, each of which is coupled to an associated rotor assembly, can be operated through an operating stroke ranging from a neutral position in which the shaft of the associated rotor extends vertically to a maximum stroke position in the which shaft of the associated rotor assembly is tilted a maximum possible amount. First and second steering assist mechanisms, each of which is coupled to an associated steering linkage, reduce the associated handle retention forces required to hold the associated handle to a particular position, after moving the handle to that position, to less than about 15 lbs throughout the stroke of the operating handle.

A further aspect of the invention discloses a ride-on trowel steering system having a torsion bar, a load lever, a steering rod, and a transfer lever. The steering rod is supported by a frame of a trowel and is rotatable relative thereto. The load lever is connected to the torsion bar and the transfer lever extends from the torsion bar and is constructed to engage the steering rod. The steering system includes an interlock assembly disposed between the transfer lever and the steering rod for selectively isolating a load of the torsion bar from rotating the steering rod.

Still another aspect of the invention resides in a method of manually steering a ride-on trowel with reduced operator effort than is required for previously known ride-on trowels.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
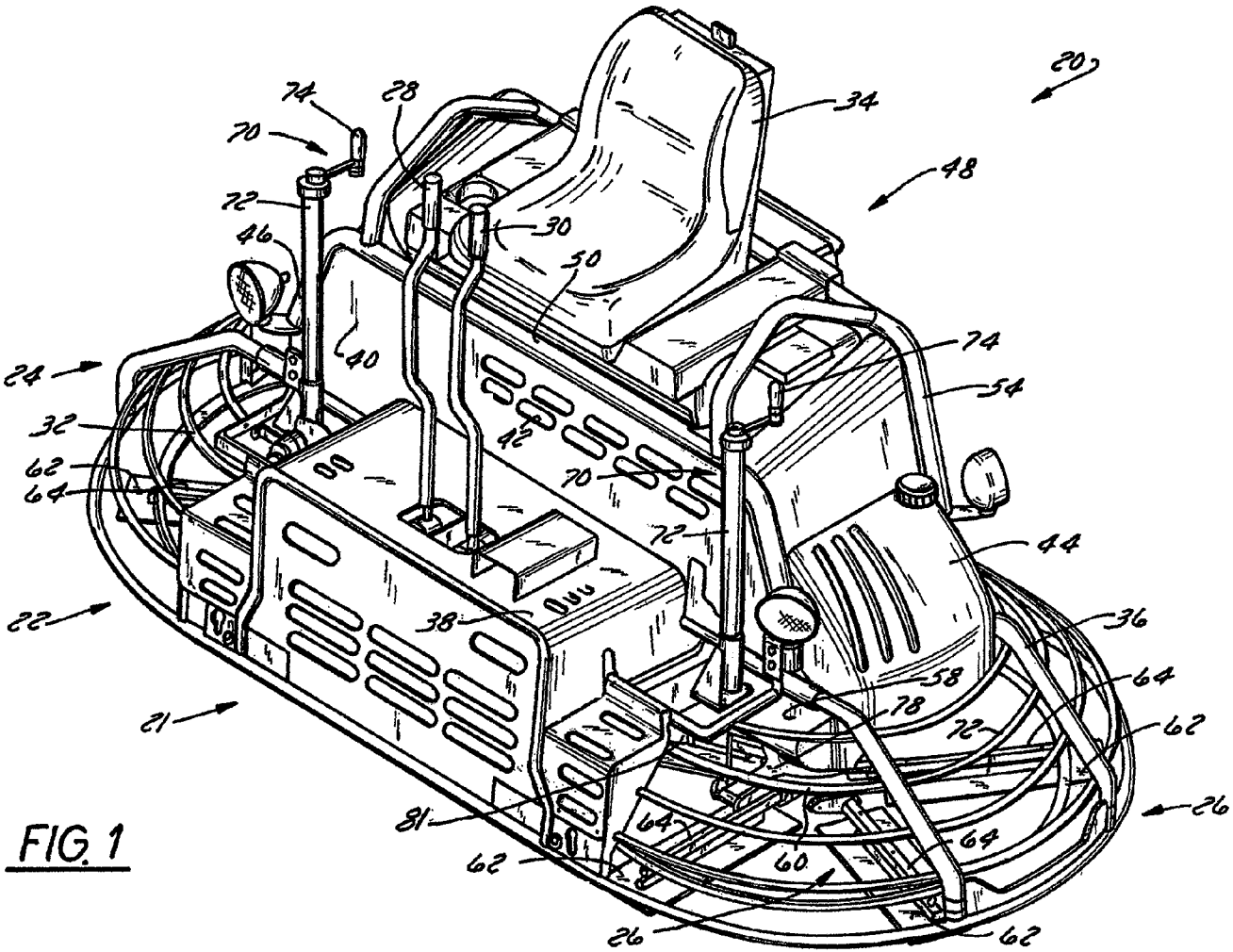
FIG. 1 is a perspective view of a riding power trowel equipped with the present invention.

FIG. 1 shows a self-propelled riding concrete finishing trowel 20 equipped with a steering system 22 according to present invention. Steering system 22 steers machine 20 by tilting the driven shafts of the rotor assemblies 24, 26 of machine 20 without requiring the imposition of fatiguing actuating forces by the machine's operator. Steering system 22 includes one, and preferably two, control arms or handles 28, 30 that extend beyond a shroud or cage 32 of trowel 20. Handles 28, 30 are oriented with respect to trowel 20 to be manipulated by an operator positioned in a seat 34.

Handles 28, 30 are operationally coupled to rotor assemblies 24, 26 such that manipulation of handles 28, 30 manipulates the position of rotor assembly 24, 26 relative to a frame 36 of trowel 20, respectively. In the typical case in which the machine is laterally steered by pivoting a gearbox of at least one rotor assembly about two axes, at least one of handles 28, 30 is constructed to be movable in the fore and aft directions as well as side-to-side directions. Although shown as what is commonly understood as a riding or ride-on trowel, it is appreciated that the present invention is applicable to any powered concrete finishing trowel that is steered by tilting one or more rotor assemblies with respect to a frame of the trowel. It is conceivable that walk-behind trowels could be steered in this or a similar manner.

Referring to FIGS. 1-7, and initially to FIG. 1 in particular, concrete finishing trowel 20 in accordance with a preferred embodiment of the invention includes as its major components rigid metallic frame 36, an upper deck 38 mounted on frame 36, an operator's platform or pedestal 40 provided on the deck, and right and left rotor assemblies 24, 26, respectively, extending downwardly from deck 38 and supporting the finishing machine 20 on the surface to be finished. The rotor assemblies 24 and 26 rotate towards the operator, or counterclockwise and clockwise, respectively, to perform a finishing operation. Cage 32 is positioned at the outer perimeter of machine 20 and extends downwardly from frame 36 to the vicinity of the surface to be finished. The pedestal 40 is positioned generally longitudinally centrally on deck 38 at a rear portion thereof and supports operator's seat 34. A fuel tank 44 is disposed adjacent the left side of pedestal 40, and a water retardant tank 46 is disposed on the right side of pedestal 40. A lift cage assembly 48, best seen in FIG. 1, is attached to the upper surface of the deck 38 beneath pedestal 40 and seat 34.

Figure 3:
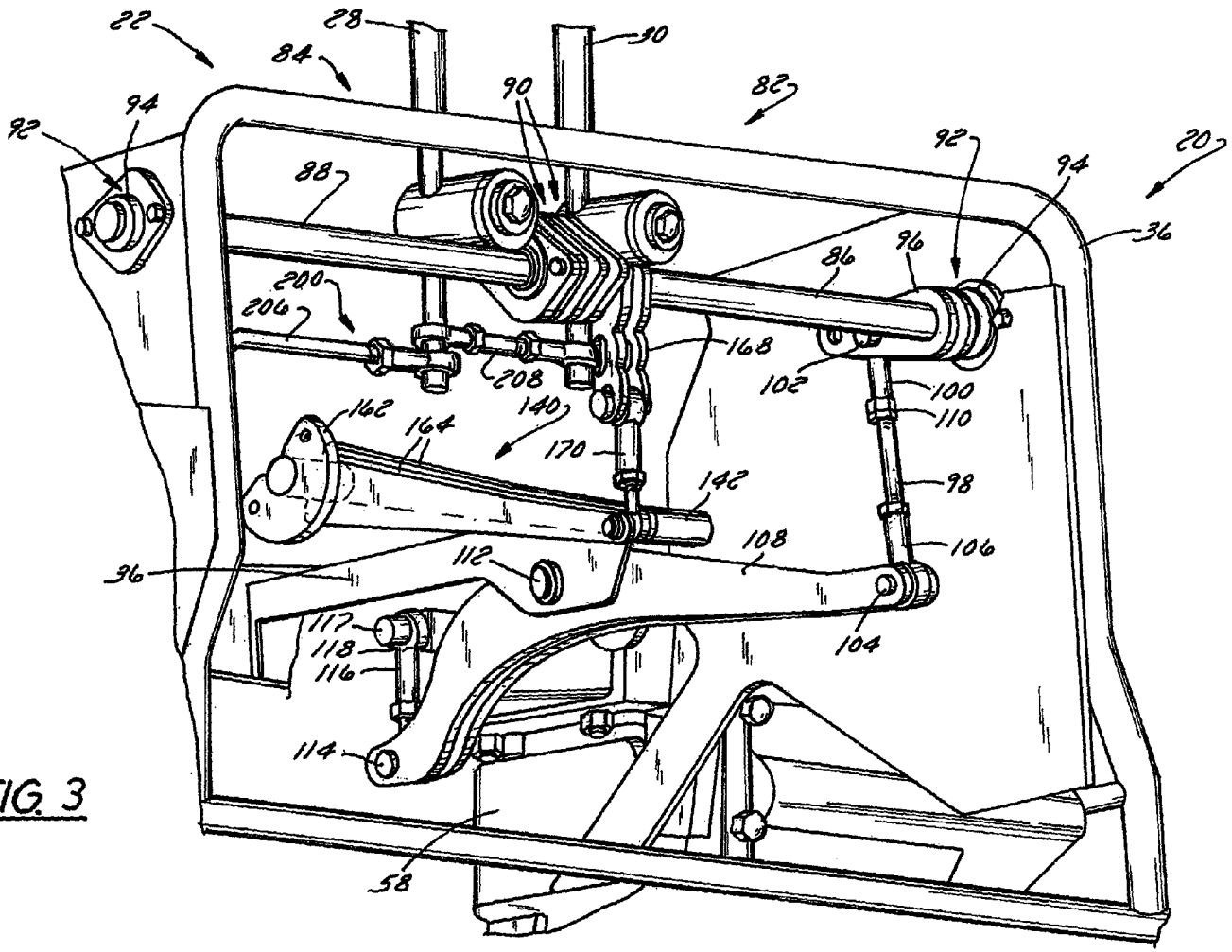
FIG. 3 is front perspective view of the steering assembly shown in FIG. 2.
Figure 6:
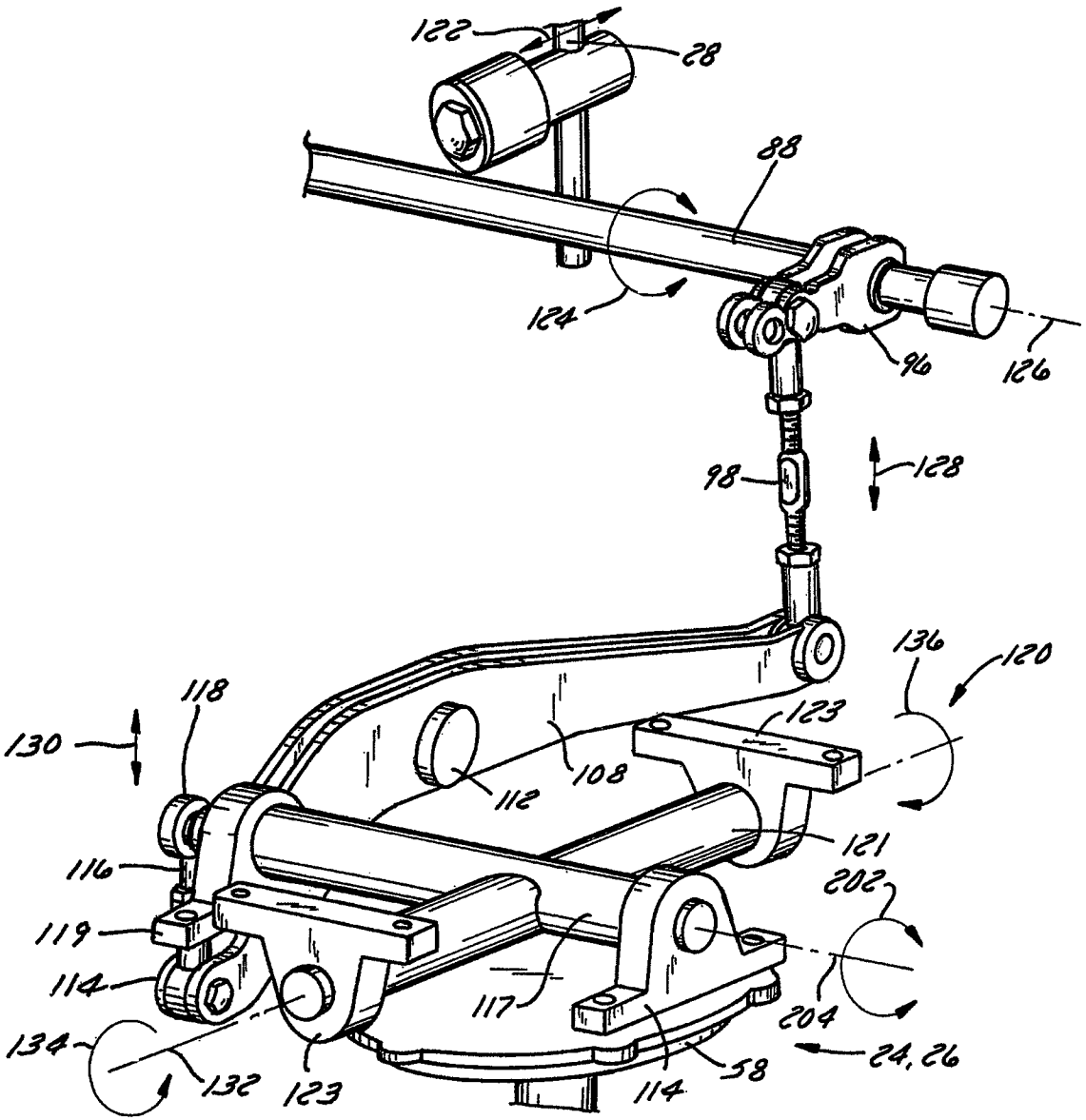
FIG. 6 is a schematic representation of the steering assembly shown in FIG. 3.

Referring to FIGS. 1, 3, and 6, each rotor assembly 24, 26 includes a gearbox 58, a driven shaft 60 extending downwardly from the gearbox, and a plurality of circumferentially-spaced blades 62 supported on the driven shaft 60 via radial support arms 64 and extending radially outwardly from the bottom end of the driven shaft 60 so as to rest on the concrete surface. Each gearbox 58 is mounted on the undersurface of the deck 38 so as to be tiltable relative to deck 38 and frame 36 for reasons detailed below.

The pitch of the blades 62 of each of the right and left rotor assemblies 24 and 26 can be individually adjusted by a dedicated blade pitch adjustment assembly 70. Each blade pitch adjustment assembly 70 includes a generally vertical post 72 and a crank 74 which is mounted on top of the post 72, and which can be rotated by an operator positioned in seat 34 to vary the pitch of the trowel blades 62. In the typical arrangement, a thrust collar (not shown) cooperates with a yoke 78 that is movable to force the thrust collar 76 into a position pivoting trowel blades 62 about an axis extending perpendicular to the axis of the driven shaft 60. A tension cable 80 extends from the crank 74, through the post 72, and to the yoke 78 to interconnect the yoke 78 with the crank 74. Rotation of the crank 74 adjusts the yoke's angle to move the thrust collar 76 up or down thereby providing a desired degree of trowel blade pitch adjustment. The pitch of blades 62 is often varied as the material being finished sets and becomes more resistant to being worked by the blades. A power concrete finishing trowel having this type of blade pitch adjustment assembly is disclosed, e.g., in U.S. Pat. No. 2,887,934 to Whiteman, the disclosure of which is hereby incorporated by reference.

Both rotor assemblies 24 and 26, as well as other powered components of the finishing trowel 20, are driven by a power source such as internal combustion engine 42 mounted under operator's seat 34. The size of engine 42 will vary with the size of the machine 20 and the number of rotor assemblies powered by the engine. The illustrated two-rotor 48" machine typically will employ an engine of about 35 hp. Rotor assemblies 24 and 26 are connected to engine 42 and can be tilted for steering purposes via steering system 22 (FIGS. 2-7).

As is typical of riding concrete finishing trowels of this type, the machine 20 is steered by tilting a portion or all of each of the rotor assemblies 24 and 26 so that the rotation of the blades 62 generates horizontal forces that propel machine 20. The steering direction is generally perpendicular to the direction of rotor assembly tilt. Hence, side-to-side and fore-and-aft rotor assembly tilting cause machine 20 to move forward/reverse and left/right, respectively. The most expeditious way to effect the tilting required for steering control is by tilting the entire rotor assemblies 24 and 26, including the gearboxes 58. The discussion that follows therefore will describe a preferred embodiment in which the entire gearboxes 58 tilt, it being understood that the invention is equally applicable to systems in which other components of the rotor assemblies 24 and 26 are also tilted for steering control.

More specifically, the machine 20 is steered to move forward by tilting the gearboxes 58 laterally to increase the pressure on the inner blades of each rotor assembly 24, 26 and is steered to move backwards by tilting the gearboxes 58 laterally to increase the pressure on the outer blades of each rotor assembly 24, 26. Crab or side-to-side steering requires tilting of only one gearbox (the gearbox of the right rotor assembly 24 in the illustrated embodiment), with forward tilting of right rotor assembly 24 increasing the pressure on the front blades of the rotor assembly 24 to steer the machine 20 to the right. Similarly, rearward tilting of rotor assembly 24 increases the pressure on the back blades of the rotor assembly 24 thereby steering machine 20 to the left.

Figure 2:
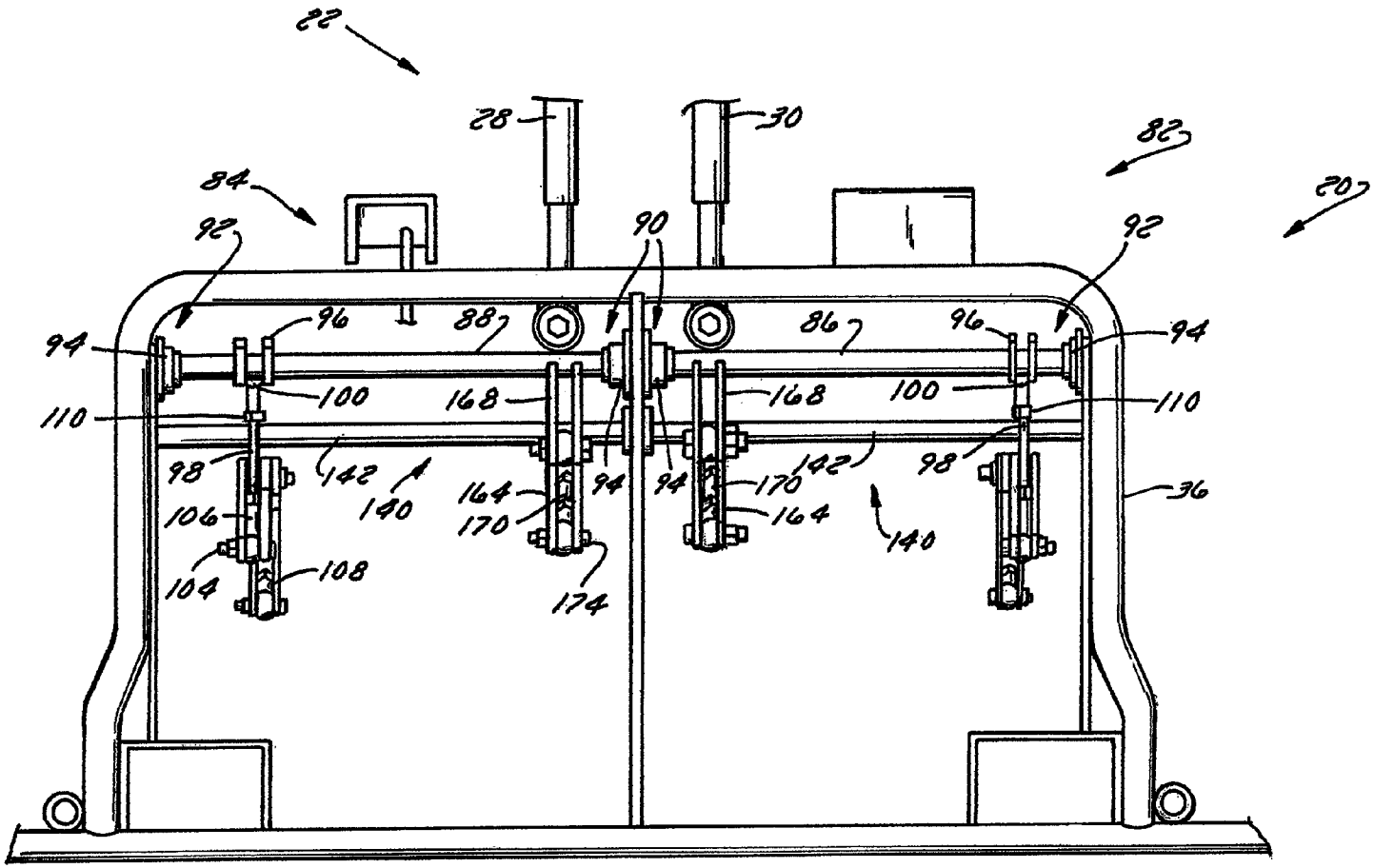
FIG. 2 is a front elevational view of the power trowel shown in FIG. 1 with a center portion of a cage of the trowel being shown as cut away to expose more a steering assembly of the trowel.
Figure 4:
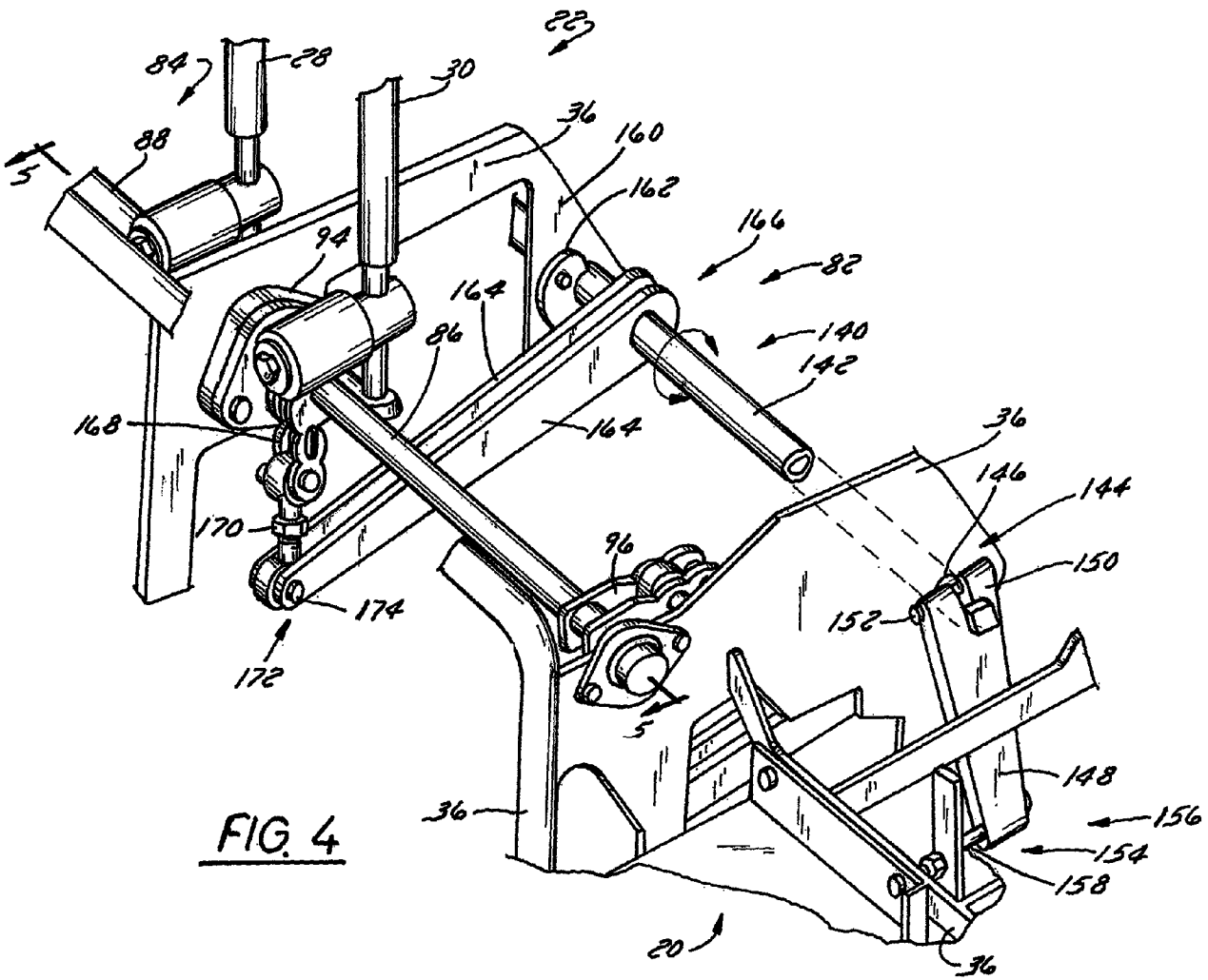
FIG. 4 is a side perspective view of the steering assembly shown in FIG. 3.

Steering system 22 tilts the gearboxes 58 of the right and left rotor assemblies 24, 26 in response to manipulation of handles 28, 30 by the operator. Referring to FIGS. 2-4, steering system 22 generally includes a left rotor steering linkage 82 and a right rotor steering linkage 84. As best shown in FIG. 2, (except for the fact that the right steering linkage contains additional components enabling left/right steering) left and right rotor steering linkages 82, 84 are generally mirror images of one another. Each steering rod 86, 88 includes a first end 90 and a second end 92 that are rotationally coupled to frame 36 of machine 20. Bearing 94 supports each of the generally opposite ends of steering rods 86, 88 such that the steering rods can be rotated relative to frame 36. An arm 96 extends generally rearwardly from each steering rod 86, 88 such that rotation of the respective steering rod pivots arm 96 about an axis of the respective steering rod 86, 88.

A link 98 is connected to each steering arm 96 at a location behind the steering rod 86, 88. Link 98 includes a first end 100 having a pivot 102 for pivotably connecting first end 100 of link 98 to steering arm 96. Another pivot 104 pivotably connects a second end 106 of link 98 to a rocker arm 108. Preferably, link 98 includes an adjuster 110 for adjusting a length of link 98, thereby reducing play in steering system 22 and facilitating presets. As best shown in FIGS. 3 and 6, a pivot 112 secures rocker arm 108 to frame 36 such that rocker arm 108 can be rotated about pivot 112. A pivot pin 114 connects another link 116 to an end of rocker arm 108 generally opposite link 98. Link 116 includes a journal 118 connected to a pivot lever assembly 120 associated with each gearbox 58. As shown in FIG. 6, translation of handle 28 in fore and aft directions, indicated by arrow 122, imparts a rotational force, indicated by arrow 124, upon steering rod 88. Rotation 124 pivots arm 96 about axis 126 of steering rod 88. Such motion translates link 98 generally vertically, as indicated by arrow 128. The motion of link 98 is translated through rocker arm 108 such that, when link 98 is raised or lowered, rocker arm 108 rotates about pivot 112 to lower or raise pivot link 116.

The upper end of link 116 is pivotally connected to an outer end of a laterally extending rod 117. The opposite ends of the rod 117 are journalled in pillow block bearings 119 attached to the upper surface of the gearbox 58. A central portion of the rod 117 is welded or otherwise affixed to a longitudinally extending rod 121 having opposite ends journalled in pillow block bearings 123. The pillow block bearings 123 are bolted on the underside of the frame.

With this arrangement, translation of link 116 along the direction indicated by arrow 130 tilts gearbox 58 about a longitudinal axis 132 of pivot lever assembly 120. Accordingly, forward translation of handle 28 tilts gearbox 58 in the direction indicated by arrow 134 such that blades 62 contact the material being finished so as to move the machine in a forward direction. In a similar manner, rearward translation of handle 28 tilts gearbox 58 in the direction indicated by arrow 136 such that blades 62 to contact the material being finished so as to move the machine in a rearward direction. The shaft 121 rotates in pillow block bearings 123 to accommodate this motion.

Figure 5:
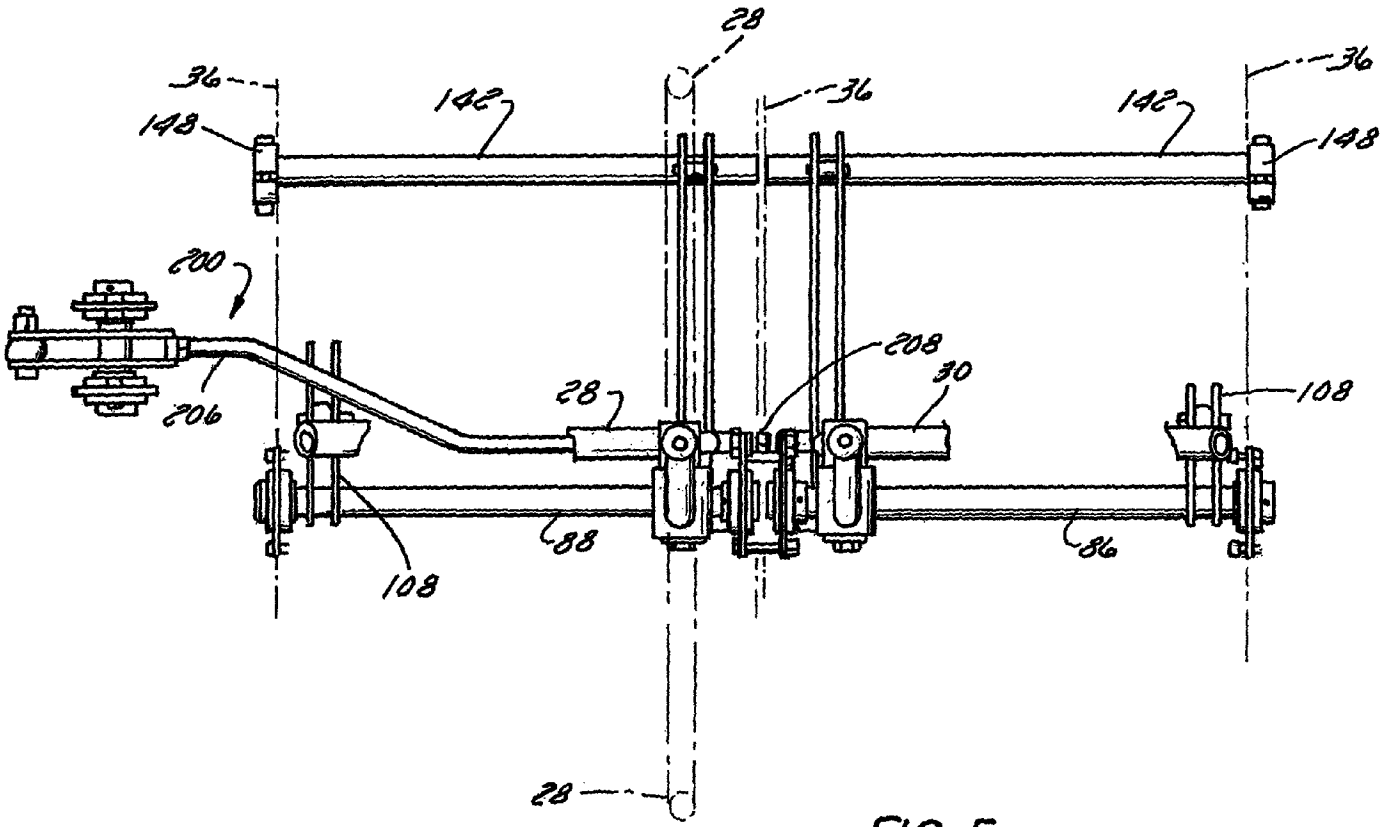
FIG. 5 is a sectional view of the steering system along line 5-5 shown in FIG. 4.

Referring to FIGS. 3, 5, and 6, steering system 22 additionally includes a crab or lateral steering linkage 200. Lateral steering linkage 200 extends to only one of rotor assemblies 24, 26 and is constructed to rotate, indicated by arrow 202 (FIG. 6), one of rotor assemblies 24, 26 about an axis 204 that is generally aligned with a longitudinal axis of machine 20. Such a construction results in blades 62 imparting a lateral, crab, or side-to-side force to machine 20 upon lateral or side-to-side motion of handles 28, 30 relative to frame 36. As shown in FIG. 3, lateral steering linkage 200 includes a gear box link 206 and a handle link 208. Gear box link 206 extends between one of the handles 28 or 30 and the respective rotor assembly 24 or 26. As only one gear box is tiltable about an axis generally aligned with a longitudinal axis of machine 20, a handle link 208 secures handles 28, 30 such that lateral motion of machine 20 can be accomplished with lateral translation of either handle 28 or handle 30.

Although handle link 208 connects the operation of handles 28, 30 for lateral motion, handle link 208 pivots relative to both handle 28 and handle 30 such that each handle 28, 30 can be moved fore and aft independent of the other handle. Such a construction allows either of handles 28, 30 to control lateral motion of machine 20 and each handle 28, 30 to control the forward and rearward direction of travel tilting of the rotor assembly 24, 26. Depending on the size of the machine and the degree of tilt desired, the forces required to provide the desired gear box tilting can be considerable.

Referring to FIGS. 2-4, steering system 22 includes an assistance system 140 associated with each handle 28, 30. Each assistance system 140 is constructed to overcome at least a portion of the load associated with tilting gearboxes 58. Each assistance system 140 includes a biasing device that is operationally connected to a respective steering rod 86, 88. In the embodiment of FIGS. 1-6, the biasing device comprises a torsion bar 142. As best shown in FIG. 4, an outer end 144 of torsion bar 142 passes through an opening 146 formed in frame 36 and loosely secures a position of torsion bar 142 relative to frame 36. An upper end anchor bar 148 is rigidly secured to outer end 144 of torsion bar 142 proximate opening 146. An upper end 150 of anchor bar 148 includes a clamp 152 that secures the orientation of anchor bar 148 relative to torsion bar 142. Anchor bar 148 includes an adjuster 154 positioned proximate an opposite, lower end 156 of the anchor bar 148. Adjuster 154 includes a threaded rod 158 that engages anchor bar 148 and frame 36 such that the position of anchor bar 148 relative to frame 36 can be adjusted. The position of adjuster 154 and anchor bar 148 determines the preloading of torsion bar 142. Another, inboard end 160 of torsion bar 142 is loosely supported by a saddle 162 that is attached to frame 36. This construction allows torsion bar 142 to move independent of frame 36 and provides for variable loading of torsion bar 142 such that the variable load is selectively communicated to handles 28, 30.

A rigid lever 164 is rigidly attached to torsion bar 142 generally between ends 144, 160. The first end 166 of rigid lever 164 is secured to torsion bar 142 such that rigid lever 164 does not rotate independent of torsion bar 142. As best seen in FIG. 3, a link assembly 168, 170 connects the font end of anchor link 164 to the shaft 86, 88. Upper link 168 comprises a clevis fixed to the steering rod 86 or 88 at an upper end end. Lower link 170 comprises a turnbuckle pivotally attached to the bottom of the upper link 168 at its upper end and to the lever 164 at its lower end. Rotation of steering rod 86 or 88 causes the upper link 168 to swing, resulting in over-center motion of the lower link 170 about its upper end with the assistance of the preload imposed in the torsion bar 142. Such a construction selectively communicates the preload of torsion bar 142 to the respective handle 28, 30 of steering system 22 to assist in overcoming the forces experienced at handles 28, 30 due to the gravitational loading of rotor assemblies 24, 26 during tilting of the rotor assemblies. Accordingly, twisting the torsion bar 142 through pivoting of the anchor bar 148 imparts a preload on the lever 164 that assists the operator in overcoming a portion of the force otherwise associated with tilting rotor assemblies 24, 26 to effectuate steering of machine 20.

Figure 7:
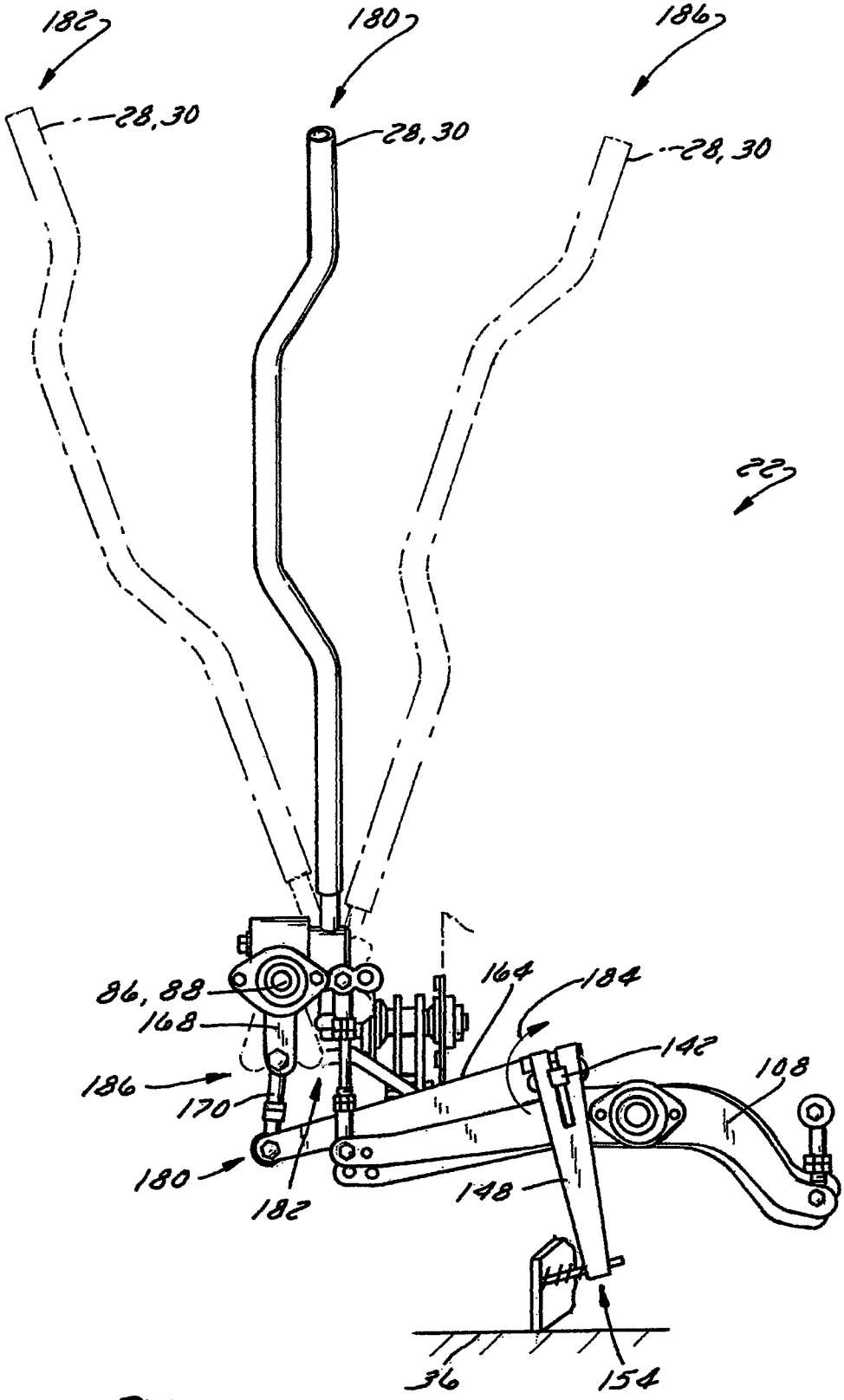
FIG. 7 is a side elevational view of the steering assembly shown in FIG. 3.

FIGS. 5 and 7 show the various positions of handles 28, 30. For clarity, only the position of handle 28 is varied. As shown in FIG. 7, when handles 28, 30 are oriented in the neutral position, as indicated by arrow 180, fixed link 168 and adjustable link 170 are oriented in an under center position with respect to an axis of steering rod 86, 88. Such an orientation isolates handles 28, 30 from the bias of torsion bar 142 when handles 28, 30 are oriented in neutral position 180. Translation of handles 28, 30 toward a forward position, indicated by arrow 182, translates fixed link 168 rearward of neutral position 180 such that the bias or pre-load of torsion bar 142, indicated by arrow 184, is communicated from torsion bar 142 to steering rod 86, 88 via rigid lever 164 and fixed and adjustable links 168, 170. Similarly, translation of handle 28 toward a rearward position, indicated by arrow 186, translates fixed link 168 forward of neutral position 180. Such an orientation also translates the pre-load 184 of torsion bar 142 to steering rod 86, 88. Accordingly, the load of torsion bar 142 is communicated to steering rod 86, 88 for both forward and rearward translation of handles 28, 30, thereby assisting in both forward and rearward steering of machine 20 and rotor assemblies 24, 26, respectively. That is, assistance system 140 assists in overcoming the load associated with tilting rotor assemblies 24, 26 for both forward and backward travel of machine 20. The same preload resists return of the handles 28, 30 to their neutral position, but not enough to overcome gravity. Hence, the preload cushions return of the handles 28 and 30 to their neutral positions.

Adjuster 154 and anchor bar 148 are also constructed to provide variable loading of torsion bar 142. Such a construction allows steering system 22 to be quickly and efficiently adapted to any of a number of machines and a number of machine configurations. Adjuster 154 also allows assistance system 140 to be uniquely configured to an individual operator's preferences. That is, assistance system 140 can be configured to allow as much of the resistance to tilting of the rotor to be communicated to handles 28, 30 as an operator desires. Understandably, it is envisioned that steering assistance system 140 support most, if not all, of the load commonly communicated to handles 28, 30 through steering rods 86, 88 during a rotor tilting operation. Accordingly, it is envisioned that assistance system 140 be configured to support anywhere from 50 to 800 or more lbs. Understandably these values are only dependent on the amount of resistance an operator desires to overcome and the total amount of resistance generated by the tilting operation. It is envisioned that assistance system 140 and torsion bar 142 could be configured to provide any of a number of steering assistance values.

Figure 8:
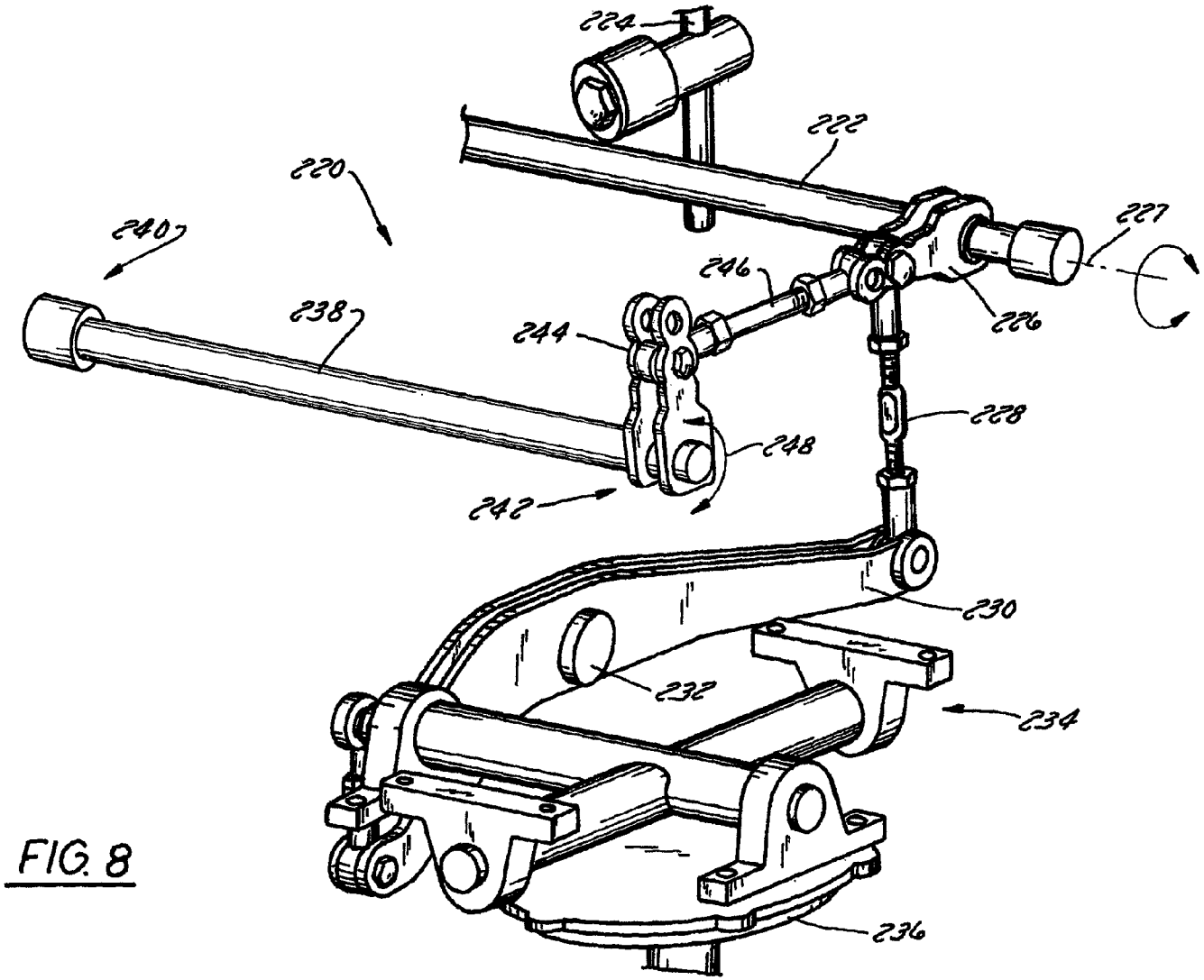
FIG. 8 schematically illustrates another embodiment of a steering assembly for a riding power trowel according to the present invention.
Figure 9:
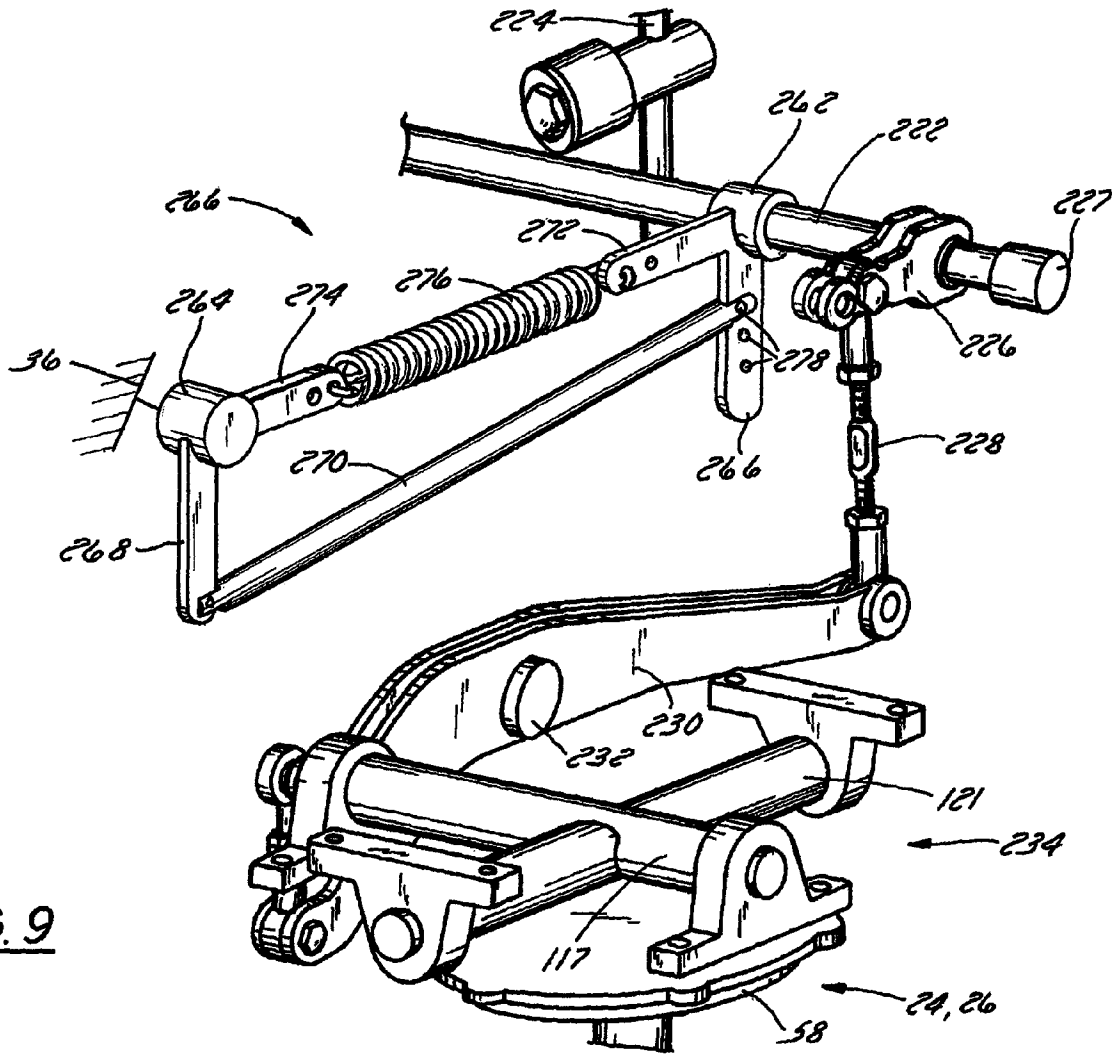
FIG. 9 schematically illustrates yet another embodiment of a steering assembly for a riding power trowel according to the present invention.
Figure 10:
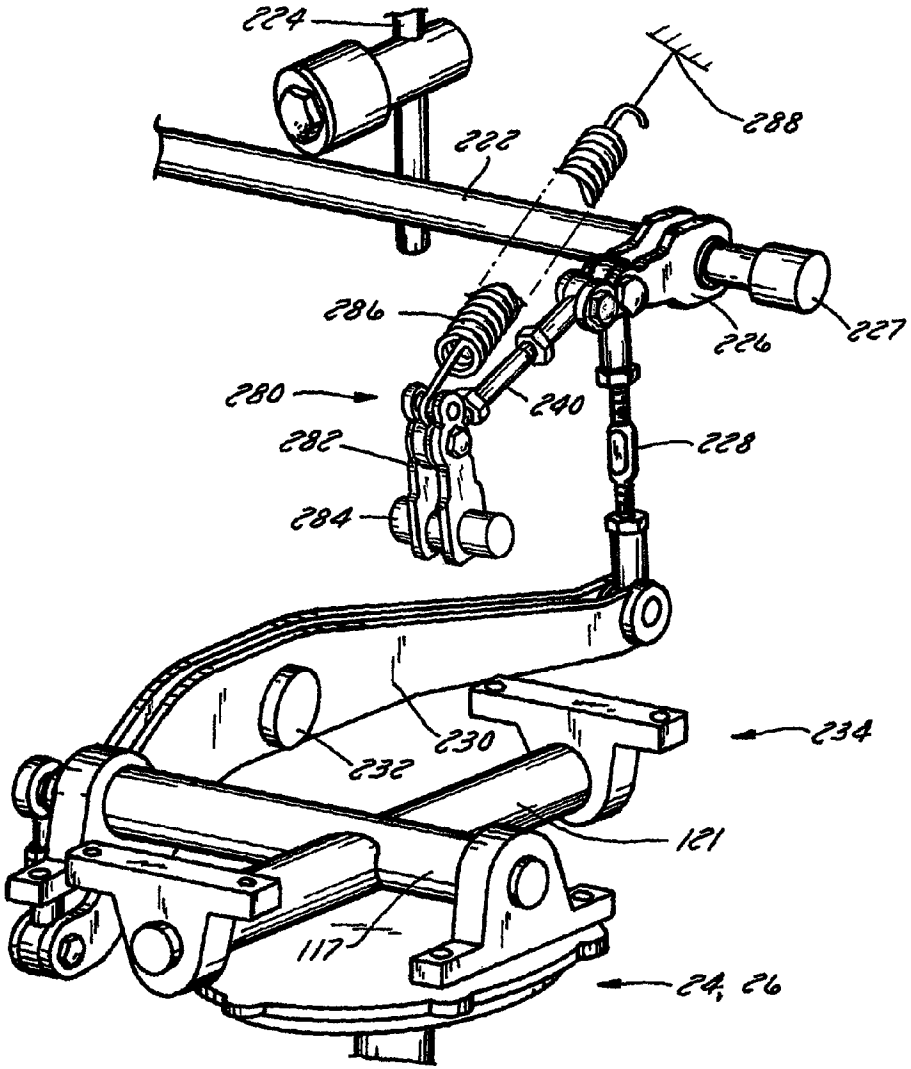
FIG. 10 schematically illustrates a further embodiment of a steering assembly for a riding power trowel according to the present invention.

FIGS. 8-10 show simplified representations of alternate embodiments of steering assistance systems for use with ride-on trowels 20 according to the present invention. As shown in FIG. 8, a steering assistance system 220 according to another embodiment of the invention includes a steering rod 222 that is rotationally connected to a steering handle 224. An arm 226 extends from steering rod 222 such that rotation of rod 222 rotates arm 226 about an axis 227 of rod 222. A link 228 is coupled between a rocker arm 230 and arm 226. Rocker arm 230 is constructed to pivot about a pivot pin 232 attached to a frame of the machine. Rocker arm 230 is connected to a pivot lever assembly 234 such that movement of rocker arm 230 manipulates a gearbox 236 generally similar to the operation of rocker arm 108. A biasing lever or torsion bar 238 includes a first end 240 that is attached to a frame of the machine and another end 242 having an arm 244 extending therefrom. A link 246 connects arm 244 and arm 226 of steering rod 222. Link 246 is adjustable to define the relative degree of rotation or loading, indicated by arrow 248, of torsion bar 238. Link 246 is generally aligned under center of axis 227 of steering rod 222 such that manipulation of handle 224 in either a forward or rearward direction allows communication of the load of torsion bar 238 to steering rod 222. Additionally, it is appreciated that either of torsion bars 142, 238 be provided in the form of a torsion spring or other member configured to retain rotational energy.

FIG. 9 shows another alternate embodiment of a steering assistance system 260 according to the present invention. The connection between the steering rod 222 and pivot lever assembly is substantially similar to that already described with respect to steering assistance systems 140 and 220. Assistance system 260 includes a first link 262 secured to steering rod 222 and another link 264 pivotably secured to frame 36. Each link 262, 264 includes a first arm 266, 268 interconnected by a rod 270. A second arm 272, 274 of each link 262, 264 engages a biasing link or compression spring 276. Arm 266 includes a number of holes 278 constructed to engage link 270 such that a preloading of compression spring 276 is manipulated by manipulation of the connection of link 270 and arm 266. Arms 272, 274 are generally aligned with the axis of steering rod 222 when handle 224 is located in a neutral position. Rotation of handle 224 in either a forward or rearward direction upsets the over center orientation of compression spring 276 and steering arm 222 thereby allowing the communication of the preload of compression spring 276 to steering rod 222. Accordingly, steering assistance system 260 also assists an operator in overcoming the forces associated with tilting either of rotor assemblies 24, 26.

FIG. 10 shows a further embodiment of a steering assistance system 280 according to the present invention. Handle 224 is coupled to steering rod 222 and connected to pivot lever assembly 234 and rotor assemblies 24, 26 generally similar to systems 220, 260. Arm 226 extends from steering rod 222 and is connected to rocker arm 230 via link 228. Assistance system 280 includes a link 282 constructed to rotate about a pivot 284 having a position that is fixed relative to rocker arm 230. A biasing link or tension spring 286 extends between link 282 and a fixed position 288. An adjustable connection link 290 extends between arm 226 and link 282. Link 290 engages link 282 generally between tension spring 286 and pivot 284. Link 290 is generally oriented over center of steering rod 222 such that manipulation of handle 224 in either a forward or rearward direction communicates the load of tension spring 286 to steering rod 222 in the direction of rotation of the steering rod. Adjustable link 290 allows assistance system 280 to also be configured to provide any of a variety of preload conditions to tension spring 286 such that the user can quickly and efficiently configure the assistance system to provide the desired level of steering assistance.

Each steering assistance system 140, 220, 260, and 280 provides a power trowel steering assistance system that assists in operator in overcoming the resistance associated with translating the steering handles to tilt to the rotator assemblies. The steering assistance systems assist the operator in performing both forward and rearward translation of each of the steering handles of the machine. Furthermore, referring to FIG. 11, it has been determined that very few power trowel steer assist systems provide a relatively uniform and substantial assistance to overcoming the anti-tilt forces of the rotor assemblies over a majority of the range of motion of the handles of such devices.

Figure 11:
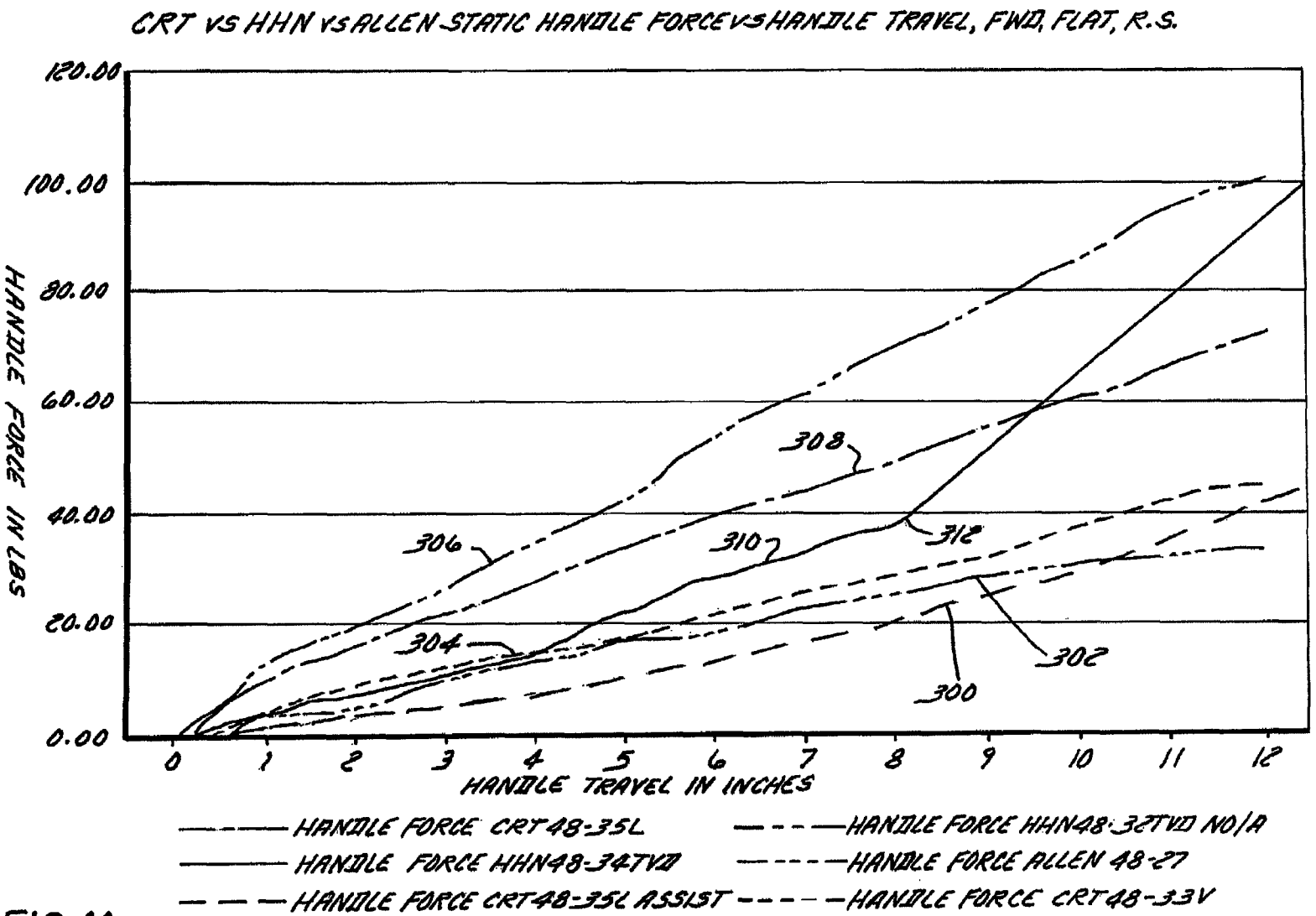
FIG. 11 is a graphical representation comparing the operation of the steering assemblies shown in FIGS. 2-7 and 9 to other known steering assemblies.

FIG. 11 shows graphically that a riding trowel equipped with a steering assistance system according to the second preferred embodiment of the present invention, indicated by trend 300, requires the least amount of operator effort through approximately ten inches of handle travel. A riding trowel equipped with a steering assistance system according to the second preferred embodiment of the present invention, indicated by trends 304, required similarly low operator efforts through the full range of handle stroke. These efforts are commensurate with those required for operation of a manually steered trowel manufactured by Allen Engineering, as depicted by curve 302. The Allen Engineering system achieves these low actuation forces by utilizing a specially designed linkage with high mechanical advantage. However, because the Allen Engineering system lacks a steering assist mechanism that stores potential energy and releases it to assist in steering, the forces required to hold the steering handles in a particular position after moving to that position are commensurate with those required to move the handle to that position. However, because the inventive steering assist system uses released potential energy to assist in steering, the forces required to maintain the handle in a particular position after achieving that position are relatively low, as will be discussed below in conjunction with FIG. 12.

The required operator effort of both inventive systems referenced above s much less than is required to operate a prior art trowel that is manufactured by Wacker Corporation and that has a steering system that is quite similar to those described herein but for the inventive steering assist mechanism. Compare curves 300 or 304 to curve 306.

Figure 12:
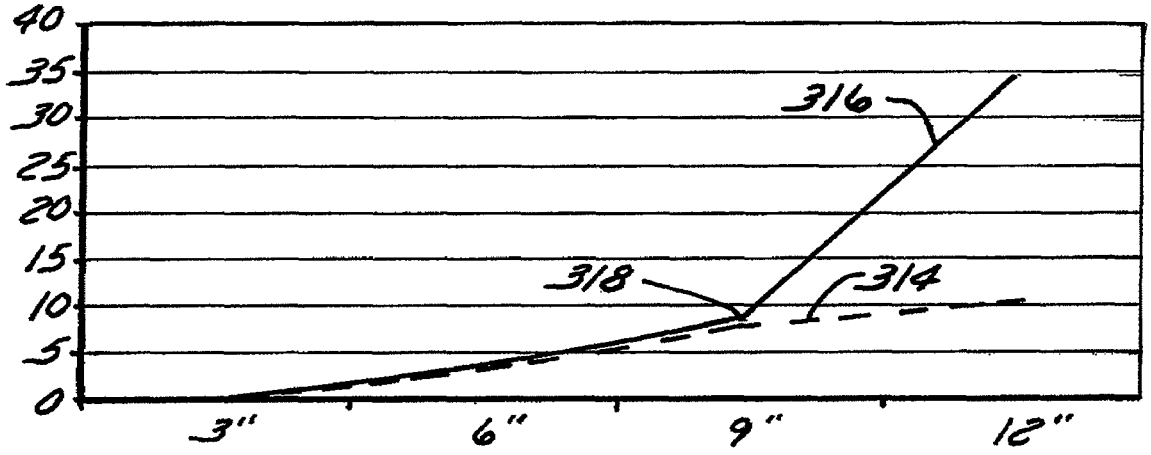
FIG. 12 is a graphical representation comparing holding forces required of the steering assembly shown in FIG. 2-7 to those required for a prior known assisted steering system.

The operator effort required for both inventive systems referenced above is also comparable or less than a prior art assisted steering system marketed by Whiteman and described in U.S. Pat. No. 5,899,631 through about the first 8" of handle stroke, as represented by a comparison of coves 300 or 304 to curve 310. Thereafter, the required efforts increase only gradually for the systems constructed in accordance with the present invention. In contrast, the required actuation forces increase dramatically for the Whiteman system after about the first 8"" of handle stroke due to the fact that Whiteman's steering assist mechanism dramatically reduces assistance beyond that stroke. (Note break point 312 in curve 310). In fact, the Whiteman system requires more effort than the Wacker unassisted system at strokes beyond about 9½. This break point 312 in the Whiteman actuation force curve 310 is also reflected in a break point 318 in the curve 316 of retired retention forces at a particular handle position as depicted in FIG. 12. As can be seen by curve 314 representing retention forces for the above-referenced trowel constructed in accordance with the first preferred embodiment of the invention, the required retention forces for the inventive trowel are less than those required for the Whiteman steering assisted trowel over about the last 3" or 25% of handle stroke. The maximum retention force required for the inventive trowel described above are about 10 lbs. This is dramatically less than the approximately 35 lb maximum retention force required of the Whiteman assisted steering system and substantially less than is required in all known unassisted systems in which the retention forces are commensurate with the actuating forces. This differential is very significant because, on large surfaces, an operator may have to hold the handles in a particular position for a relatively long period of time to propel the machine forward at a desired, constant speed, resulting in operator fatigue.

Hence, the inventive system reduces operator effort to impose and maintain steering forces through the operating stroke of the steering levers.

It is appreciated that many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims. It is intended that all such changes and/or modifications be incorporated in the appending claims.

What is claimed is:

1. A steering system for a riding power trowel, the trowel having at least one rotor assembly including a rotatable shaft and a plurality of blades, the rotor assembly being tiltable to steer the power trowel comprising:

at least one handle that can be manipulated by an operator, the handle having an operating stroke ranging from a neutral position in which the shaft of the rotor extends at least substantially vertically to a maximum stroke position in which the shaft of the rotor assembly is tilted a maximum possible amount;

a steering linkage that connects the at least one handle to a rotor assembly and that tilts the rotor assembly upon handle manipulation; and a steering assist mechanism that includes a biasing element which imposes a preload on the steering linkage and which, upon movement of the steering linkage, releases potential energy to reduce handle actuation forces required to move the handle to a particular position and to retain the handle in the particular position, wherein the steering assist mechanism reduces handle retention forces, required to maintain the handle in a particular position after moving the handle to that position, to less than about 20 lbs throughout the operating stroke of the handle.

2. The steering assist system as recited in claim 1, wherein the steering assist mechanism reduces handle retention forces to less than about 15 lbs throughout the operating stroke of the handle.

3. The steering assist system as recited in claim 1, wherein the steering assist mechanism reduces handle retention forces to no more than about 10 lbs throughout the operating stroke of the operating.

4. A steering system for a riding power trowel, the trowel having at least one rotor assembly including a rotatable shaft and a plurality of blades, the rotor assembly being tiltable to steer the power trowel comprising:

at least one handle that can be manipulated by an operator, the handle having an operating stroke ranging from a neutral position in which the shaft of the rotor extends at least substantially vertically to a maximum stroke position in which the shaft of the rotor assembly is tilted a maximum possible amount;

a steering linkage that connects the at least one handle to a rotor assembly and that tilts the rotor assembly upon handle manipulation; and a steering assist mechanism that imposes a preload on the steering linkage to reduce handle actuation forces required to move the handle to a particular position and to retain the handle in the particular position, wherein the steering assist mechanism reduces handle retention forces, required to maintain the handle in a particular position after moving the handle to that position, to less than about 20 lbs throughout the operating stroke of the handle, wherein the steering assist mechanism comprises a torsion bar which, upon handle movement away from the neutral position, imposes a load on the handle that assists handle motion away from the neutral position.

5. The steering system as recited in claim 4, further comprising a biasing link engaged with the steering linkage and extending from the torsion bar between generally opposite ends of the torsion bar; and a load link that is connected to the torsion bar and that imparts a preload on the torsion bar.

6. The steering system of claim 5, further comprising an adjuster that engages the load link and that can be operated to adjust an amount of the preload.

7. The steering system of claim 5, wherein the preload is adjustable between approximately 50 lbs. and approximately 750 lbs.

8. The steering system of claim 5, wherein the steering linkage further comprises a link assembly connected to the at least one handle and the biasing link, the link assembly aligning a load of the biasing link with an axis of rotation of the steering link to isolate the at least one handle from the preload when the at least one handle is in the neutral position thereof.

9. The steering system of claim 1, wherein the biasing element of the steering assist mechanism includes a spring that counteracts the effects of gravitation forces on handle motion away from the neutral position.

10. A concrete finishing trowel comprising:

a frame;

a rotor assembly extending downwardly from the frame, the rotor assembly having a shaft that supports a plurality of blades, the rotor assembly being tiltable to steer the trowel;

an engine that drives the shaft of the rotor assembly to translate the blades across a concrete material;

a pivotal steering handle;

a steering linkage which connects the steering handle to the rotor assembly to tilt the rotor assembly relative to the frame;

a steering assist mechanism including a biasing element which is coupled to the steering linkage, wherein the biasing element stores potential energy and releases potential energy upon handle pivoting to reduce reduces handle retention forces required to hold the steering handle in a particular position, after moving the handle to that position, to less than about 15 lbs throughout the stroke of the steering handle.

11. The trowel of claim 10, wherein the steering assist mechanism further comprises links extending between the biasing element and the steering linkage, the links isolating loading of the biasing link from the associated steering handle when the steering handle is positioned in a neutral position thereof.

12. The trowel of claim 10, wherein the steering assist mechanism further comprises an adjuster that adjusts the preload imposed by the steering assist mechanism.

13. The trowel of claim 10, wherein the trowel includes first and second rotor assemblies, first and second steering linkages, each of which is coupled to a respective rotor assembly, first and second steering handles, each of which is coupled to a respective steering linkage, and first and second steering assist mechanisms, each of which is coupled to an associated steering linkage, and wherein only one of the first and second rotor assemblies is tiltable about more than one axis.

14. A concrete finishing trowel comprising:

a frame;

a rotor assembly extending downwardly from the frame, the rotor assembly having a shaft that supports a plurality of blades, the rotor assembly being tiltable to steer the trowel;

an engine that drives the shaft of the rotor assembly to translate the blades across a concrete material;

a pivotal steering handle;

a steering linkage which connects the steering handle to the rotor assembly to tilt the rotor assembly relative to the frame;

a steering assist mechanism which is coupled to the steering linkage and which reduces handle retention forces required to hold the steering handle in a particular position, after moving the handle to that position, to less than about 15 lbs throughout the stroke of the steering handle, wherein the steering assist mechanism comprises a torsion bar and a lever that is rigidly connected to the torsion bar and extends between the torsion bar and the steering linkage.

15. The trowel of claim 14, further comprising a load lever connected to the torsion bar;

a steering rod supported by the frame and rotatable relative thereto;

a transfer lever extending from the torsion bar and constructed to engage the steering rod; and an interlock assembly disposed between the transfer lever and the steering rod for selectively isolating a load of the torsion bar from rotating the steering rod.

16. The trowel of claim 15, wherein the interlock comprises a first link pivotably connected to a second link, the first and second links configured to be generally aligned during isolation of the load of the torsion bar from the steering rod.

17. The trowel of claim 16, wherein the load lever and the transfer lever are attached to the torsion bar on generally opposite sides of a portion of a frame of the trowel.

18. The trowel of claim 15, further comprising an adjuster assembly engaged with the load lever and configured to adjust a position of the load lever relative to the transfer lever.

19. A method comprising:

providing a power trowel having at least one rotor assembly including a rotatable shaft and a plurality of blades, the rotor assembly being tiltable to steer the power trowel, a handle that can be manipulated by an operator, and a steering linkage that connects the handle to the rotor assembly and that tilts the rotor assembly upon handle manipulation, steering the trowel by moving the handle through an operating stroke ranging from a neutral position in which the shaft of the rotor extends vertically to a maximum stroke position in the shaft of the rotor assembly is tilted a maximum possible amount; and during the steering step, assisting steering by imposing a preload on the steering linkage by releasing potential energy stored in a biasing element, wherein the preload reduces handle retention forces, required to maintain the handle in a particular position after pivoting the handle to that position, to less than about 20 lbs throughout the stroke of the operating handle.

20. The method of claim 19, wherein the biasing element comprises a twisted torsion bar.

* * * * *